US010106753B1

(12) United States Patent
Graham et al.

(10) Patent No.: US 10,106,753 B1
(45) Date of Patent: Oct. 23, 2018

(54) COAL GASIFICATION PROCESS WITH CONVERSION OF CO2 TO OXYGEN GASIFIER FEED PRODUCING CARBON BY-PRODUCT

(71) Applicants: Uschi M. Graham, Lexington, KY (US); Burtron H. Davis, Georgetown, KY (US)

(72) Inventors: Uschi M. Graham, Lexington, KY (US); Burtron H. Davis, Georgetown, KY (US)

( * ) Notice: Subject to any disclaimer, the term of this patent is extended or adjusted under 35 U.S.C. 154(b) by 188 days.

(21) Appl. No.: 14/544,699

(22) Filed: Feb. 5, 2015

Related U.S. Application Data

(60) Provisional application No. 61/965,674, filed on Feb. 5, 2014.

(51) Int. Cl.
*C01B 3/34* (2006.01)
*C10J 3/82* (2006.01)
*C10K 1/00* (2006.01)

(52) U.S. Cl.
CPC ..... *C10J 3/82* (2013.01); *C10K 1/005* (2013.01); *C10J 2300/093* (2013.01); (Continued)

(58) Field of Classification Search
CPC ..... C01J 2300/1603; C01B 2203/0233; C01B 2203/025; C01B 2203/0283; C01B 2203/0405; C01B 2203/0415; C01B 2203/043; C01B 2203/0475; C01B 2203/0485; C01B 2203/062; C01B 2203/068; C01B 2203/0894; C01B 2203/1076; C01B 2203/1294; C01B 2203/141; C01B 2203/142; C01B 3/025; C01B 3/363; C01B 3/382; C01B 3/384; C01B 3/52; C01B 3/34; C10J 2300/0916; C10J 2300/093; C10J 2300/0946; (Continued)

(56) References Cited

U.S. PATENT DOCUMENTS 4,524,581 A 6/1985 Cascone et al.
7,728,182 B2 6/2010 Melnickhuk
(Continued)

FOREIGN PATENT DOCUMENTS

WO WO2012168251 * 12/2012

OTHER PUBLICATIONS

Yin et al., Capture and electrochemical conversion of CO2 to value added carbon and oxygen by molten salt electorlysis, Energy Environ Sci, 2013, 6, 1538-1545.*

*Primary Examiner* — Melvin C. Mayes
*Assistant Examiner* — Smita S Patel
(74) *Attorney, Agent, or Firm* — Carrithers Law Office, PLLC

(57) ABSTRACT

A process and apparatus for the enhancement of syngas (CO and $H_2$) to fuels production utilizing a carbon based feedstock, (for example coal) by exploiting some, or all, of the hot $CO_2$ produced during the gasification step, and converting the $CO_2$ through electrochemical reactions into oxygen ($O_2$) and carbon via a molten salt reactor and directing the oxygen back to the gasifier to minimize or eliminate the need for an oxygen plant, while the carbon by-product (granular carbon) will be used for a variety of adsorbents for environmental applications.

1 Claim, 1 Drawing Sheet

(52) U.S. Cl.
CPC ..... *C10J 2300/0959* (2013.01); *C10J 2300/0976* (2013.01); *C10J 2300/1603* (2013.01); *C10J 2300/1618* (2013.01); *C10J 2300/1815* (2013.01)

(58) Field of Classification Search
CPC ..... C10J 2300/0959; C10J 2300/0983; C10J 2300/0996; C10J 2300/1618; C10J 2300/1659; C10J 2300/1665; C10J 2300/1668; C10J 2300/1675; C10J 2300/1678; C10J 2300/1815; C10J 2300/1884; C10J 3/466; C10J 3/54; C01C 1/0405; C01C 1/0488
See application file for complete search history.

(56) References Cited

U.S. PATENT DOCUMENTS

| | | | | |
|---|---|---|---|---|
| 8,088,196 | B2 | 1/2012 | White et al. | |
| 8,146,368 | B2 | 4/2012 | Yakobson et al. | |
| 8,377,154 | B2 * | 2/2013 | Ariyapadi | C01B 3/025 423/644 |
| 8,435,326 | B2 | 5/2013 | Schmit et al. | |
| 8,435,332 | B2 | 5/2013 | Christie et al. | |
| 8,435,478 | B2 | 5/2013 | Feng et al. | |
| 8,580,153 | B2 | 11/2013 | Vauk et al. | |
| 2010/0282644 | A1 | 11/2010 | O'Connor et al. | |
| 2010/0298450 | A1 | 11/2010 | Datta et al. | |
| 2011/0085966 | A1 | 4/2011 | Vauk et al. | |
| 2011/0290661 | A1 | 12/2011 | Niioka | |
| 2012/0056431 | A1 | 3/2012 | Bland et al. | |
| 2012/0111051 | A1 | 5/2012 | Kulkarni | |
| 2012/0193580 | A1 | 8/2012 | Feng et al. | |
| 2013/0156686 | A1 | 6/2013 | Vauk et al. | |
| 2013/0203142 | A1 | 8/2013 | Young | |
| 2013/0229018 | A1 | 9/2013 | Karni et al. | |
| 2013/0256113 | A1 | 10/2013 | Tumiatti et al. | |
| 2013/0283761 | A1 | 10/2013 | Takeuchi | |
| 2013/0287663 | A1 | 10/2013 | Zhang et al. | |

* cited by examiner

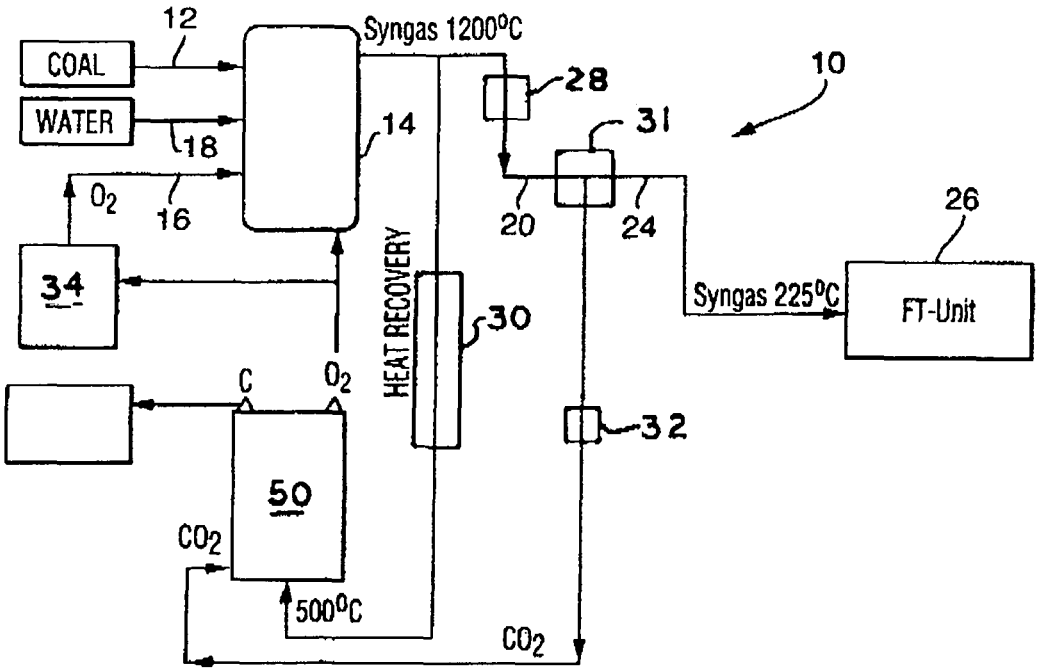
12
COAL
WATER
18
14
Syngas 1200°C
28
10
31
20
24
26
$O_2$
16
34
HEAT RECOVERY
30
Syngas 225°C
FT-Unit
C
$O_2$
32
50
$CO_2$
500°C
$CO_2$

COAL GASIFICATION PROCESS WITH CONVERSION OF CO2 TO OXYGEN GASIFIER FEED PRODUCING CARBON BY-PRODUCT

CROSS REFERENCE TO RELATED APPLICATIONS

This application claims priority from Provisional Application Ser. No. 61/965,674 filed on Feb. 5, 2014 which is incorporated by reference herein in its entirety.

FIELD OF INVENTION

This invention relates to an apparatus and coal gasification process to produce SYNGAS with the conversion of $CO_2$ into oxygen and a carbon by-product.

BACKGROUND OF INVENTION

Coal and other fossil fuels are strategic fuels around the world and make up one of the most abundant energy resources available. The development of low $CO_2$ emissions is critical to delivery of clean energy and climate control associated with fossil fuel use. Carbon dioxide capture-enabling technologies in coal-fired energy arena include integrated coal gasification technology. This technology uses sequestration technologies, but does not involve the chemical conversion of $CO_2$ to oxygen or other useful products.

Coal gasification processes provide for the conversion of coal, char, or coke to a gaseous product by reaction with heated air, oxygen, steam, or carbon dioxide or mixtures. The product of coal gasification is a mixture containing hydrogen and carbon monoxide and varying amounts of nitrogen, carbon dioxide, steam, hydrogen sulfide, organic sulfur compounds, tar, and small amounts of other contaminants depending on the selected gasification process.

Coal gasification involves a method of producing a syngas from coal and oxygen at a constant rate under defined pressure and temperature regions. Later the process requires removing sulfur compounds and other contaminants, followed by feeding the cleaned syngas to a chemical (for example methanol) synthesis reaction. The unconverted syngas can be burned for direct base load power generation replacing more expensive fuels. The gasification process produces a synthesis gas having, typically, a 1.2/1 ratio of CO to $H_2$ and a lesser amount of $CO_2$, S, $CH_4$, among others. The stoichiometric requirement will limit the conversion of the syngas stream. Since only a limited fraction, typically about 50% of the available hydrogen is converted in the once-through methanol synthesis, the process will convert a maximum of only about 25% of the available syngas to a storable liquid methanol fuel. In the conventional production of methanol, the CO component of the syngas is partially shifted by reaction with water vapor in a water gas reaction to produce $CO_2$ and additional $H_2$.

DESCRIPTION OF PRIOR ART

U.S. Pat. Nos. 3,986,349 and 4,092,825 disclose a process for generating electrical power from solid carbonaceous materials in open-cycle gas turbines to meet variable power demands. The process involves the conversion of coal to a combustible synthesis gas formed by its reaction with steam and oxygen. The synthesis gas is then divided into two portions, one of which is contacted with both Fischer-Tropsch and hydrogenation catalysts to produce a variety of synthetic hydrocarbons. The normally gaseous portion of the product is separated and recombined with the second portion of the synthesis gas stream, and the combined streams are subsequently combusted and utilized as fuels in an electricity-generating gas turbine.

As set forth in U.S. Pat. No. 6,586,480 hereby incorporated by reference, there are a number of well known coal gasification processes for the production of feedstreams which have hydrogen gas to carbon monoxide ratios ($H_2$/CO) in the range of 0.6 to 1.5. Typical of these are the Koppers-Totzek, Winkler and Lurgi processes. It is also well known in the art that these syngas processes can be readily modified to adjust the ratios of hydrogen to carbon monoxide in the product stream to provide a ratio that is more suitable for use in the downstream conversion processes of the installation to maximize production of a particular product. For example, the desired end-product may be a high purity, high BTU SNG gas, a low BTU clean refinery gas, a syngas for methanol production.

The typical gasifier is a counter flow device, whereby the coal flows downward under the force of gravity, while air and steam move upward through the coal bed to heat and gasify the coal. Raw coal is fed to a relatively cool zone in the upper portion of the gasifier near where coal gases and other volatiles leave the device.

A conventional LURGI pressure gasifier comprises a pressure vessel having at its upper end a coal lock hopper through which sized coal is introduced under pressure. The coal bed is stirred at its upper end to maintain porosity of the devolatilization zone and to break up any forming agglomerates. The coal is heated to between 1800° F. and 2300° F. by adding heated steam and oxygen at the lower end of the pressure vessel. A rotating grate is disposed within the lower end of the pressure vessel and is charged with coal to be gasified.

Conventional Morgantown Energy Technology Center (METC) gasifiers are similar in that the coal is introduced at the top and air/steam are introduced at the bottom in a countercurrent manner. Typically, a pressurized lock hopper supplies coal to a variable speed rotary feeder which dispenses coal to a screw feeder. The screw feeder runs at a constant speed which is fast enough so that it always moves the coal into the volume of the pressure vessel before it can be hot enough to become sticky and initiate blockage.

Another method for the method for the gasification of carbonaceous matter by plasma arc pyrolysis is set forth in U.S. Pat. No. 4,187,504 and incorporated by reference herein is as follows. Apparatus and method for gasification of carbonaceous matter by plasma arc pyrolysis are disclosed. A refractory-lined furnace is provided with a depression along its base for holding a pool of molten metal which acts as the external electrode for a bank of long arc column plasma torches which provide a heat mass for the process. The plasma arc pressure imparts momentum to the surface of the melt and causes it to flow in cusping eddy currents during the process. Crushed coal is deposited through the roof of the furnace by a rotary feeder in continuous plural streams. The coal is devolatilized in a matter of milliseconds and the volatiles are cracked as the coal falls by gravity through the interior of the furnace. The remaining carbon-rich char collects at plural sites on the surface of the melt and the mounds of char are rotated by the eddy currents. Steam is continuously injected into the furnace to produce hydrocarbon gases through reaction with the carbon-rich char. A residence time of five to thirty minutes produces carbon utilization of up to 92 percent. The hot raw gases are directed through a gas cooler where heat is extracted for producing the process steam and the cooled raw gases are upgraded to pipeline quality by conventional carbon dioxide and moisture removal techniques and by methanization with catalysts. The raw gas may also be burned directly as a medium-Btu gas or used as a reductant in the direct reduction of iron ore.

A preferred method of coal gasification is set forth in U.S. Pat. No. 8,252,074 for a "Method of Operating a Fixed Bed Dry Bottom Gasifier" available from the Sasol-Lurgi Technology Company which is incorporated by reference in its entirety. The process employs a method of operating a fixed bed dry bottom gasifier includes feeding coarse particulate coal with an average particle size of at least 1 mm and an ash fusion temperature increasing agent into a gasification chamber of the gasifier to form a coal bed, feeding a gasification agent into the gasification chamber, and gasifying the coarse particulate coal in the gasification chamber to produce synthesis gas as well as ash. The ash is collected in an ash bed below the coal, and the synthesis gas and the ash are removed from the gasification chamber. The gasifier is a pressurized gasifier. A sized coal feed with particles greater than 4 mm enters the gasification reactor through the coal lock and moves down through a bed formed inside the gasification reactor. An oxygen feed and a steam feed enter at a bottom of the bed, through the grate. Oxygen is required to combust some of the coal to supply energy for the endothermic gasification reactions. Typically, part of the steam that is used is generated in a gasifier jacket from boiler feed water that is fed to the jacket. The steam has a pressure of 40 bar (gauge) and a temperature of about 390° C., with the boiler feed water being at a pressure of about 40 bar (gauge) and a temperature of about 105° C. and the oxygen being at a pressure of about 29 bar (gauge) and a temperature of about 140° C. Within the gasifier bed, different reaction zones are distinguishable from top to bottom, namely a drying zone where moisture is released, a devolatization zone where pyrolysis takes place, a reduction zone or gasification zone where mainly endothermic reactions occur, an exothermic oxidation or combustion zone, and an ash bed at the bottom of the gasifier bed. As a result of the counter-current mode of operation, hot ash exchanges heat with cold incoming reagents, such as steam and oxygen or air, while at the same time hot raw gas exchanges heat with cold incoming coal. This results in an ash stream and a raw gas stream, respectively leaving the gasifier from the ash lock and the gasification reactor, at relatively low temperatures compared to other types of gasifiers, which improves the thermal efficiency and lowers the steam and oxygen consumption of the gasifier. The ash passes through the rotating grate and the ash lock before being removed. In the pyrolysis zone of the gasifier, tars, oils and pitches and the like are released. These pyrolysis products are not destroyed, in view of the relatively low operating temperature of the pressurized dry ash moving bed gasifier. The pyrolysis products can be used to create valuable co-products such as ammonia, sulphur, cresols and phenols. The following are some of the reactions that take place in the gasifier:

Combustion:

$$C+O_2 \rightarrow CO_2 \Delta H=-406 \text{ kJ/mol}$$

Reduction:

$$C+CO_2 \rightarrow 2CO \Delta H=160 \text{ kJ/mol}$$

$$C+H_2O \rightarrow CO+H_2 \Delta H=119 \text{ kJ/mol}$$

Water-Gas Shift:

$$CO+H_2O \rightarrow CO_2+H_2 \Delta_2 \Delta H=-40 \text{ kJ/mol}$$

Methane Formation:

$$C+2H_2 \rightarrow CH_4 \Delta H=-87 \text{ kJ/mol}$$

$$CO+3H_2 \rightarrow CH_4+H_2O \Delta H=-206 \text{ kJ/mol}$$

$$3C+2H_2O \rightarrow CH_4+2CO \Delta H=182 \text{ kJ/mol}$$

The temperature profile in the gasifier varies between about 800° C. and 1200° C. as the coal moves through the different zones in the gasification reactor. The raw gas stream leaves the gasification reactor typically at a temperature of between about 460° C. and 500° C., but may be lower.

During coal gasification (or other solid carbonaceous materials) oxygen is fed to a reactor to create a synfuel (CO+H2), but a substantial amount of $CO_2$ (and other impurities) will be generated and the release creates environmental problems that need to be addressed. During coal combustion (which is different from gasification) large volumes of $CO_2$ are produced that are difficult to capture or reuse. These and other problems have thus spurred the search for coal gasification processes which will produce a clean fuel gas in which the $CO_2$ can be removed or converted to useful by products prior to the use of the syngas in chemicals or fuels production applications.

Conventional methods use of $CO_2$ from coal gasification has been focused on sequestration and injection in wells for example in the recovery of natural gas, oil and more recently in fracking applications. The use of $CO_2$ towards useful products through chemical conversion processes requires large amounts of energy due to the strong bond between the carbon and oxygen atoms in the $CO_2$ molecule. There are many useful applications for $CO_2$ to other products, but the energy needs have prevented many of these applications from being realized since they were not practical and cost efficient.

Fisher-Tropsch is a chemical process for conversion of coal (or other related solid feedstocks) derived syngas to liquid petroleum products such as gas and diesel fuel. The coal must first be converted into gaseous reactants (carbon monoxide, hydrogen, carbon dioxide, and alkanes). This conversion is called gasification and the product is called synthesis gas "SYNGAS".

A combustible hydrocarbonaceous material such as coal, lignite, petroleum refining residue, or the like is gasified into a synthesis gas mixture, CO and $H_2$ through a suitable high temperature and pressure gasification process, e.g., the Texaco, Shell-Koppers or modified Koppers-Totzek processes. The syngas process is operated in a temperature range of 800-1200° C. The resultant pressurized syngas is cleaned of impurities, gaseous sulfur compounds and used as fuel in chemical processes such as the Fisher-Tropsch process (gas-to-liquids processes).

In coal processes, several reactions are employed to adjust the $H_2$/CO ratio. Most important is the water gas shift reaction, which provides a source of hydrogen at the expense of carbon monoxide $$H_2O+CO \rightarrow H_2+CO_2.$$

The Fischer-Tropsch process is operated in a temperature range from 150-300° C. which can be accomplished with a multi tubular fixed bed reactor, entrained flow reactor, slurry reactor, and/or fluid-bed and circulating catalysts (riser) reactor. For instance, SASOL utilizes a circulating iron catalyst reactor. Conversion of a mixture of $H_2$ and CO into aliphatic products is a multi-step reaction with several intermediate steps or processes. The hydrocarbon chain is formed by repeated sequences in which hydrogen atoms are added to carbon and oxygen, wherein the C—O bond is split and a new C—C bond is formed. For each $CH_2$ group produced $CO+2H_2 \rightarrow (CH_2)+H_2O$, several reactions are necessary including adsorption of CO, splitting of the C—O bond, dissociative adsorption of $2H_2$, transfer of 2H to the oxygen to yield $H_2O$, desorption of $H_2O$, and transfer of 2H to the carbon to yield $CH_2$. The conversion of CO to alkanes involves hydrogenation of CO, the hydrogenolysis of C—O bonds, and the formation of C—C bonds.

SUMMARY OF THE INVENTION

This invention relates to an apparatus and coal gasification process to produce SYNGAS with the conversion of $CO_2$ into oxygen and a carbon by-product. The oxygen produced from the conversion of the carbon dioxide is intended as a substitute feed for replacement of a conventional oxygen plant which makes up an integral part of the gasification process. The oxygen is derived from $CO_2$ produced during coal gasification and, therefore, removes and utilizes unwanted $CO_2$, making the gasification process a more carbon neutral energy process. The $CO_2$ is converted to a useful product ($O_2$). The use of a molten salt reactor which can separate $CO_2$ into both oxygen and carbon products requires energy in form of heat to keep the salts in a molten state so that $CO_2$ can be dissolved and dissociated. Syngas from a gasifier on the other hand is too hot to be used in a gas-to-liquids chemical synthesis process, (for example Fischer Tropsch Synthesis) and the heat recovery process will be used to heat the molten salt reactor and drive the conversion/dissociation of $CO_2$ that will lead to the production of oxygen and carbon by-product. This invention involves a process to produce oxygen from $CO_2$ produced in a gasifier and feeds the oxygen back into the gasification process eliminating CO2 along the way and making the gas-to-liquids process less $CO_2$ intensive.

More particularly, the process and apparatus provides a means for the enhancement of syngas, (CO and $H_2$), to fuels production utilizing a carbon based (for example coal) feedstock by exploiting some, or all, of the $CO_2$ produced during the gasification step, and converting the $CO_2$ through chemical reactions into oxygen ($O_2$) and carbon and directing the oxygen back to the gasifier to minimize or eliminate the need for an oxygen plant, while the carbon by-product (granular carbon) will be used for a variety of adsorbents for environmental applications. The hot $CO_2$ product recovered from the gasifier will be passed through a series of heat exchangers, cleaned of impurities (for example sulfur) and then fed to a molten salt reactor where the $CO_2$ will be converted into oxygen and carbon through an electrochemical process. Utilizing a heat recovery process delivers the necessary energy to heat the molten metal reactor to the optimum temperature and also keep the temperature at the thermal level that allows the inlet $CO_2$ to be continuously dissolved into and dissociated in the electrolyte solution. The rate of production of oxygen and carbon at the systems electrodes depends on the stream of $CO_2$ fed to the molten salt reactor. A gasifier will be able to consume the produced oxygen in the formation of syngas thereby eliminating the need for or at least help reduce the scale of a separate oxygen plant. The syngas will be used in various chemical applications (for example Fischer Tropsch Synthesis of liquid and waxy hydrocarbons).

The Gasification process uses a known gasification vessel or reactor that generates a desirable syngas with a $H_2$/CO ratio suitable for chemical processes such as the Fischer Tropsch "FT" applications or any $H_2$ and CO syngas for other non-FT applications. The syngas exit temperature from the gasifier is typically 800-1200° C. The syngas has to be cooled and conditioned (cleaned of impurities such as sulfur, and $CO_2$ for downstream applications such as the FT process). Skillful $CO_2$ removal from the syngas is a requirement for any syngas application in FT and other chemicals production. So far, the $CO_2$ has been typically released or sequestered. In the specific case of coal gasification when compared with using natural gas to produce a syngas for FT applications, coal derived syngas produces significantly more $CO_2$ and, hence, there are more restrictions to its application. The beneficial use of $CO_2$ will create avenues for coal gasification to compete with natural gas as a more environmentally benign application.

The problem with current use of the gasification process today is that there is no reasonable use for the $CO_2$ portion of the syngas with respect to both cost and product use. The novel process provided in the instant invention is for a heat recovery method using heat exchanger 30 technology to gain CARBON NEUTRAL ENERGY used to drive the conversion dissociation of $CO_2$ into oxygen and carbon. The formation of oxygen from $CO_2$ will then be used for the gasification of coal thereby eliminating the need for an oxygen plant 34 (or at least reducing the scale of the oxygen plant). Oxygen plants are energy intensive since they typically work by extracting oxygen from air. The carbon can be used for making active carbons for environmental applications and also for the formation of carbon-specific products.

The molten slat reactor, ("MSR"), is a reactor system that uses a liquid fuel. All other reactors use solid fuel. The fuel of a molten salt reactor consists of a molten salt mix that includes a fuel salt such as uranium. This salt mix generates heat from the fission process under the right controlled conditions. Salt has a much higher boiling point than even highly pressurized water, so the MSR can generate outlet temperatures approaching 700 degrees Celsius compared to just over 300 degrees for a conventional nuclear plant. Moreover, the MSR does that at atmospheric pressure. This avoids many of the engineering challenges and added costs associated with large pressure vessels or pressurized fuel channels.

One embodiment of a modular MSR is a design by Canada's Terrestrial Energy Corporation. The unit integrates primary reactor components (the moderator, primary heat exchanger and pumps) into a sealed reactor vessel within a compact and replaceable module, referred to as the IMSR Core-unit. The replaceable core-unit concept, unlike any other reactor design, leads to the properties that create high industrial value: passive safety, operational simplicity, and lower cost. Graphite was chosen as the moderator. The IMSR is attractive due to low capital costs and low operating costs comparable to a fossil fuel power plant and operating costs that are a fraction of conventional nuclear reactor. Uranium consumption per kilowatt hour will be one-sixth of a conventional nuclear reactor. The IMSR meets the accepted definition of a small modular reactor. A 25 Mwe version is the size of a fairly deep hot tub. Its components, most importantly the IMSR Core-unit, are modular and transportable. They can be manufactured at a central production facility and can be transported to plant site on a flat-bed truck or by railcar. MSRS display excellent natural properties for decay-heat management. The IMSR design offers a "walk away safe" level of assurance: zero operator intervention, even with a total loss of site power. The IMSR has a small and relatively short-lived waste footprint. It burns its nuclear fuel far more completely and generates power with higher thermodynamic efficiency than solid fuel reactors creating only one-sixth of the long-lived Transuranic fuel waste (essentially, plutonium) per kilowatt hour compared to conventional nuclear plants.

The MSR incorporated in the process for the instant invention electrochemically converts $CO_2$ to activated carbon and oxygen at the electrodes. Oxygen is fed to the gasifier and use the $CO_2$ that is produced in the gasification step to circle back into the molten salt reactor and generate more oxygen for the gasifier. The gasification of coal will require more moles of oxygen than there are moles of $CO_2$ produced and will require some additional source of an oxygen plant. How much $CO_2$ can be converted to $O_2$ depends on the speed of dissolving $CO_2$ into the molten metal bath and the size of the molten metal reactor. The oxygen will be directed to the Oxygen Plant that is a required part of the coal gasification process. The waste $CO_2$ from coal gasification is utilized as feed material creating two useful products, oxygen for the oxygen plant and activated carbon. The heat recovery from the syngas (temperature ~800-1000° C.) to help heat the molten metal reactor (~500° C.) will bring the syngas temperature closer to the temperature of 220° to 225° C. that is typically used in a FT reactor scenario. It is contemplated that the temperature range can be expanded depending upon the desired product.

Heat recovery may be achieved using heat exchangers such as a syngas feed line, or any other route (electricity generation) to heat the molten salt reactor to a selected temperature of 500° C. The molten salt reactor has 2 electrodes; at the anode carbon will be deposited (to be upgraded to activated carbons for environmental applications) and on the cathode oxygen will be released at the rate of $CO_2$ conversion. The molten metal salt reactor is one example to use the recovered carbon-neutral heat energy to dissociate $CO_2$ to carbon and oxygen.

One preferred embodiment of the present invention involves a method and process which includes a series of steps for the gasification of coal and subsequent syngas applications that include heat energy recovery to drive the conversion/dissociation of $CO_2$ into C and $O_2$ which are beneficial products unlike $CO_2$ which is a greenhouse gas. The process uses conventional gasifiers such as units fabricated by LURGI, British Gas, or non-traditional gasifiers such as the one fabricated by AEROJET ROCKETDYNE that generate a desirable syngas with a $H_2$/CO ratio with or without additional water-gas-shift units to increase the hydrogen content of the syngas and are suitable for FT applications or any $H_2$/CO syngas for other non-FT applications. The heat recovery during the cooling of the syngas is a critical energy input (at least part of the energy required) to dissociate $CO_2$ into C and $O_2$. The syngas exit temperature from the gasifier is about 800 to 1200° C. The syngas has to be cooled and conditioned (cleaned of impurities such as sulfur, $CO_2$ for the FT process. Separation of the $CO_2$ from the syngas is an established technology and commercially available, but the use of the separated $CO_2$ towards production of chemicals (including formation of oxygen) is not established art. The CO2 is typically released or sequestered, neither being a good long term solution. A novel feature of the present process involves a cooling step involving "heat recovery" heat exchanger technology to gain CARBON-NEUTRAL ENERGY that is used to drive the conversion/dissociation of $CO_2$ into oxygen and carbon in a molten salt reactor. The formation of oxygen from $CO_2$ conversion will be used for the gasification of the coal. For example, in the present invention, the recovered heat energy form the syngas cooling will be directed to heat a molten salt reactor and keep the reactor at a selected temperature, for example a temperature of 500° C. The molten salt reactor has been demonstrated previously to electrochemically convert $CO_2$ to activated carbon and oxygen. The activated carbon is an additional value added product. The oxygen will be directed to the oxygen plant that is a required part of the coal gasification process. Heat recovery is achieved using heat exchangers, or other alternate energy generation processes such as electricity to heat the molten salt reactor to about 500° C. The molten salt reactor has two electrodes; at the anode, high surface area carbon will be deposited and oxygen will be released at the cathode. The molten metal salt reactor is one example to use carbon-neutral heat energy to dissociate $CO_2$ into carbon and oxygen or oxygen and carbon monoxide (any other chemical reaction that utilizes $CO_2$).

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein:

FIG. 1 illustrates a process flow diagram illustrating the use of a gasifier to produce syngas for a feed to a FT unit; $CO_2$ will be separated from the syngas. The syngas acts as a heat source and is typically ~800-1000° C. depending on the type of gasifier used, (but may be more or less depending upon the selected gasifier) will drive the molten salt reactor, heating the reactor to a constant 500° C. using the $CO_2$ from the gasifier as feed to produce an oxygen resource that can be fed to the gasifier. An additional carbon product is also generated and can be upgraded to useful sorbents.

DESCRIPTION OF THE PREFERRED EMBODIMENT

The present invention comprises, consists of, and/or consists essentially of a process that includes a series of steps for the gasification of coal and subsequent syngas applications that include: 1) energy (Heat) recovery to drive the conversion/dissociation of $CO_2$ into C and $O_2$ and; 2) production of $O_2$ from $CO_2$ for the oxygen plant used during gasification.

The process is uses a conventional gasifier such is available from the LURGI company, that generates a desirable syngas with a $H_2$/CO ratio suitable for FT applications, or any $H_2$/CO syngas for other non-FT applications (i.e., chemical synthesis etc.). The heat recovery during the cooling of the syngas is a critical energy input (at least part of the energy required) to spilt $CO_2$ into C and O. The syngas exit temperature from the gasifier is 800 to 1200° C. The syngas has to be cooled and conditioned (cleaned of impurities such as sulfur, $CO_2$) for the FT process. Separation of the $CO_2$ is an established technology. The cleaned syngas needs to be cooled and prepared for the FT reactor. This critical "cooling" step allows for heat recovery using heat exchanger technology to gain CARBON-NEUTRAL ENERGY that will be used to drive the conversion/dissociation of $CO_2$ into oxygen and carbon. The formation of oxygen from $CO_2$ conversion is used for the gasification of coal. For example, the recovered heat energy from the syngas will be directed to heat a molten salt reactor. The molten salt reactor electrochemically converts $CO_2$ to activated carbon and oxygen. The activated carbon is an additional value added product which may be utilized a catalyst or other carbon product. The oxygen will be directed to the oxygen plant and recycled as a required part of the coal gasification process.

Heat recovery may be achieved using heat exchangers, or any other route (electricity generation) to heat the molten salt reactor to a selected temperature, for example 500° C. The molten salt reactor has two electrodes. At the anode high surface area carbon will be deposited and oxygen will be released at the cathode. The molten metal salt reactor is one example to use the recovered carbon-neutral heat energy to dissociate $CO_2$ to carbon and oxygen.

A better understanding of the invention can be facilitated by a careful consideration of the preferred process outlined in FIG. 1. Coal and/or other combustible hydrocarbonaceous materials, which can include coke, lignite, oil shale, peat, biomass, petroleum refining residues and the like, are charged through conduit 12 to coal gasification unit 14. While the preferred embodiment utilizes coal as a preferred feed product, the carbonaceous materials can include but are not limited to, biomass (e.g., plant and/or animal matter or plant and/or animal derived matter); coal (e.g., high-sodium and low-sodium lignite, lignite, sub-bituminous, and/or anthracite); oil shale; coke; tar; asphaltenes; low ash or no ash polymers; hydrocarbon-based polymeric materials; biomass derived material; or by-product derived from manufacturing operations. The hydrocarbon-based polymeric materials can include, for example, thermoplastics, elastomers, rubbers, including polypropylenes, polyethylenes, polystyrenes, including other polyolefins, homo polymers, copolymers, block copolymers, and blends thereof; PET (polyethylene terephthalate), poly blends, other polyolefins, poly-hydrocarbons containing oxygen; heavy hydrocarbon sludge and bottoms products from petroleum refineries and petrochemical plants such as hydrocarbon waxes, blends thereof, derivatives thereof, and combinations thereof. The hydrocarbon can include a mixture or combination of two or more carbonaceous materials or a mixture or combination of two or more low ash or no ash polymers, biomass-derived materials, or by-products derived from manufacturing operations. The feedstock can include one or more recycled plastics such as polypropylene, polyethylene, polystyrene, derivatives thereof, blends thereof, or any combination thereof. Accordingly, the process can be useful for accommodating mandates for proper disposal of previously manufactured materials.

Oxygen, or another suitable gaseous stream containing substantial amounts of oxygen is charged through conduit 16 into gasifier 14, and steam, or, if preferred, liquid water is introduced through conduit 18 to the gasifier 14. It is preferred that the process will be run continuously and at a substantially constant rate.

Any one of several commercially available gasification processes can be incorporated into the process. Gasifiers such as the Texaco, the modified Koppers-Totzek and the Shell-Koppers or Lurgi are preferred, with the precise choice depending on the particular feedstock and overall integrated system. Recovery of at least some of the chemical energy converted to sensible heat.

The gasifiers contemplated for use in the process may be operated over a range of pressures and temperatures between about 15 to 1500 psi and from 750 to 1200° C. The coal gasification product, or syngas, is then, in the broadest embodiment, prepared for the removal of impurities, acid gas constituents, water vapor and the like, as well as concentrating the hydrogen over CO to create a more desired. $CO/H_2$ ratio for feed to a FT unit.

Typically, the syngas product is purified by further processing in scrubbers or other apparatus to remove entrained solids and other contaminants, and then a variety of sulfur containing and other common acid gases (H, S, COS, $CO_2$) are removed, preferably by conventional methods. The purification unit 28 can utilize pressure swing adsorption, nitrogen wash unit, cryogenic distillation, semi-permeable membranes, combinations thereof, and/or other purification processes. Absorbents used in the purification unit where applicable, can include caustic soda, potassium carbonate or other inorganic bases, and/or alanolamines. Upon exiting gas purifier, the cleaned, syngas is passed through conduit 20 to a $CO_2$ separation/recovery unit 31 and then through the necessary alkyl formate product separation apparatus. After exiting the $CO_2$ enrichment-unit through line 24, the conditioned syngas is fed to a FT unit 26.

The carbon dioxide portion can be introduced to a $CO_2$ compressor 32. The $CO_2$ compressor can be any compressor suitable, or can include any configuration of multiple compressors of any suitable type. Suitable compressors can include, but are not limited to, centrifugal compressors, axial flow compressors, reciprocating compressors, combinations thereof, trains thereof, and/or the like. The $CO_2$ compressor can produce a compressed carbon dioxide which can be sent to a heat recovery unit such as a molten salt reactor.

In at least one preferred embodiment, pure oxygen, nearly-pure oxygen, essentially-pure oxygen, or oxygen-enriched air from an oxygen plant or air separation unit ("ASU") can provide a nitrogen-lean and oxygen-rich gas (hereafter "oxidant") via line. The oxidant via line can be coupled to the gasifier 14, thereby providing at least a portion of the oxidant thereto. The use of pure or nearly-pure oxygen gas as the oxidant can allow the gasifier 14 to produce raw syngas that can be essentially nitrogen-free, e.g., containing less than about 0.5% nitrogen and/or argon. Accordingly, in at least one specific embodiment, a single ASU can provide the oxidant for the gasifier 14. In one or more embodiments, the ASU can provide from about 10%, about 30%, about 50% about 70%, about 90%, or about 100% of the total oxidant fed to the gasifier 14.

A novel feature of the present process involves a cooling step involving "heat recovery" using heat exchanger technology to gain carbon neutral energy used to drive the conversion/dissociation of $CO_2$ into oxygen and carbon (in the molten metal reactor). The formation of oxygen from $CO_2$ conversion will be used for the gasification of the coal. This creates a loop for the oxygen going into the gasifier, then being used in the coal conversion, producing CO and CO2; the CO2 will be dissociated to form oxygen (and carbon) and the oxygen will be fed back into the gasifier. The recovered heat energy form the syngas will be directed to heat the molten salt reactor that will be used to dissociate CO2 into O and C. The molten salt reactor has been demonstrated previously to electrochemically convert $CO_2$ to activated carbon and oxygen. The activated carbon is an additional value added product. The oxygen will be directed to the oxygen plant that is a required part of the coal gasification process. Heat recovery is achieved using heat exchangers, or other alternate energy generation processes such as a electricity to heat the molten salt reactor to a selected temperature, for example about 500° C. The molten salt reactor has two electrodes. At the anode, high surface area carbon will be deposited and oxygen will be released at the cathode. The molten metal salt reactor is one example to use the carbon-neutral heat energy to dissociate $CO_2$ into carbon and oxygen. The molten metal salt reactor can be further improved by modification of the electrodes and catalysts used in the electrodes to improve the catalytic performance and electrochemical conversion efficiencies.

In the present invention, the $CO_2$ from the syngas reaction is recovered and concentrated to serve as the feed to the molten salt reactor (MSR) which is heated at least partially by recirculating the syngas product there through which cools the syngas product for further processing and recovers the heat for the conversion of the $CO_2$ to form a pure carbon by product for use as a catalyst or other carbon by products and produces pure oxygen which can be used to supplement the oxygen feed to the gasifier.

The syngas product can be coupled to a Fischer Tropsch reactor or any other chemical conversion setup that utilizes a CO/H2 mixture. For example, the syngas product can be used to produce one or more FT) products, including refinery/petrochemical feedstocks, transportation fuels, synthetic crude oil, liquid fuels, lubricants, alpha olefins, waxes, and combinations thereof. The reaction can be carried out in any type reactor, e.g., fixed bed, moving bed, fluidized bed, slurry, bubbling bed, etc using copper, ruthenium, iron or cobalt based catalysts, or combination thereof, under conditions ranging from about 190° C. to about 450° C., depending on the reactor configuration. Additional reaction and catalyst details can be found in U.S. patent application Ser. No. 11/109,122 and U.S. Pat. Nos. 5,621,155; 6,682,711; 6,331,575; 6,313,062; 6,284,807; 6,136,868; 4,568,663; 4,663,305; 5,348,982; 6,319,960; 6,124,367; 6,087,405; 5,945,459; 4,992,406; 6,117,814; 5,545,674 and 6,300,268, the entirety of each being herein incorporated by reference, to the extent not inconsistent with this disclosure.

The F-T products are liquids, which can be shipped to a refinery site for further chemically reacting and upgrading to a variety of hydrocarbon products including paraffin solvents which can be hydro treated to remove olefin impurities, or employed without hydrotreating to produce a wide variety of wax products. Liquid hydrocarbon products of C16+ can be upgraded by various hydroconversion reactions such as by hydrocracking, hydroisomerization catalytic dewaxing, isodewaxing, or combinations thereof, to produce mid-distillates, diesel and jet fuels such as low freeze point jet fuel, high cetane jet fuel, and the like. In addition isoparaffinic solvents, lubricants, lube oil blending components and lube oil base stocks suitable for transportation vehicles, non-toxic drilling oils suitable for use in drilling muds, technical and medicinal grade white oil, chemical raw materials, and various specialty products are useful derivatives.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

We claim:

1. A coal gasification process and carbon dioxide conversion process consisting of the steps of producing a raw syngas from a gasifier heating coal producing a syngas product having a temperature of from 800 to 1200° C., said gasification process forming a syngas product containing a carbon dioxide where a gasifier for use in the process is operated over a range of pressure between 15 and 1500 psi and a temperature from 750 to 1200° C.;

purifying said syngas product containing said carbon dioxide with a purification unit fluidly coupled to said gasifier;

removing said carbon dioxide from said syngas product with a carbon dioxide separation/recovery unit fluidly coupled to said purification unit;

compressing said carbon dioxide with a compressor fluidly coupled to said carbon dioxide separation/recovery unit forming a concentrated carbon dioxide product forming a compressed carbon dioxide product;

cooling and reducing the temperature of said syngas product with a heat exchanger fluidly coupled to said gasifier;

recovering syngas carbon neutral heat energy removed from said syngas product during cooling with said heat exchanger and using said syngas carbon neutral heat energy to drive a conversion/disassociation of said carbon dioxide product into a carbon product and an oxygen product by circulating at least a portion of said syngas carbon neutral heat energy through a molten salt reactor fluidly coupled to said heat exchanger unit and said gasifier by:

a) heating said molten salt reactor to a selected temperature utilizing said carbon neutral heat energy generated from said heat exchanger from cooling a least a portion of said syngas product, said carbon neutral heat energy producing at least a portion of the heat necessary to operate said molten salt reactor;

b) feeding said compressed carbon dioxide product to said molten salt reactor; and c) converting and disassociating said compressed carbon dioxide product with said molten salt reactor producing carbon by-product collecting on an anode of said molten salt reactor and a pure oxygen product released at a cathode of said molten salt reactor;

feeding said pure oxygen product produced in said molten salt reactor to said gasifier; and removing said carbon by-product produced in said molten salt reactor.

* * * * *